US005834897A

United States Patent [19]

Nortrup et al.

[11] Patent Number: 5,834,897

[45] Date of Patent: Nov. 10, 1998

[54] LAMP WITH CENTERED ELECTRODE OR IN-LEAD

[75] Inventors: Edward H. Nortrup, Stoneham, Mass.; Simone P. Bazin, Bedford; Pierre G. Provost, Manchester, both of N.H.

[73] Assignee: Osram Sylvania Inc., Danvers, Mass.

[21] Appl. No.: 850,793

[22] Filed: May 2, 1997

[51] Int. Cl.[6] ..... H01J 61/30

[52] U.S. Cl. ..... 313/634; 313/623

[58] Field of Search ..... 313/25, 634, 623, 313/331, 332, 283; 445/22, 26, 27, 43; 220/2.1 R

[56] References Cited

U.S. PATENT DOCUMENTS

| | | | |
|---|---|---|---|
| 2,273,450 | 2/1942 | Rentschler | 313/25 |
| 3,548,245 | 12/1970 | Biscoff | 313/331 |
| 3,742,283 | 6/1973 | Loughridge | 313/331 |
| 3,912,960 | 10/1975 | Danko | 313/222 |
| 4,396,857 | 8/1983 | Danko | 313/634 |
| 4,891,554 | 1/1990 | Levand, Jr. et al. | 313/634 |
| 4,916,353 | 4/1990 | Danko et al. | 313/113 |
| 5,087,218 | 2/1992 | Ahlgren et al. | 445/27 |
| 5,142,195 | 8/1992 | Heider et al. | 313/623 |
| 5,252,885 | 10/1993 | Muzeroll et al. | 313/25 |
| 5,374,872 | 12/1994 | Balaschak et al. | 313/623 |
| 5,387,839 | 2/1995 | Giordano et al. | 313/623 |
| 5,457,354 | 10/1995 | Tu Tay | 313/25 |
| 5,468,168 | 11/1995 | Balaschak et al. | 445/26 |
| 5,471,110 | 11/1995 | Van Der Leeuw et al. | 313/25 |
| 5,552,670 | 9/1996 | Heider et al. | 313/625 |

*Primary Examiner*—Sandra O'Shea
*Assistant Examiner*—Michael Day
*Attorney, Agent, or Firm*—William H. McNeill

[57] ABSTRACT

An hermetically sealed arc tube 14 has a longitudinal axis 60 and contains therewithin an arc generating and sustaining medium, as is known. The ends of the arc tube 14 are sealed with press-seals 43. The seals comprise a substantially parallelepipodonal structure having oppositely disposed, planar sides 56 and 58. A molybdenum foil 50 is sealed in each of the press-seals and is substantially centrally located between the planar sides 56 and 58. An in-lead 52 is secured as by welding to an end of foil 50 and extends outwardly of the arc tube for electrical connection to a source and an electrode 46 is attached to the other end of foil 50 and projects into the arc chamber. A first rod-relief member 62 in the form of a projecting boss 64 is formed on one of the planar sides, for example, 58, and a second rod-relief member 66 in the form of a depression 68 is formed on the other of the planar sides, in this instance side 56. The rod-relief members cooperate to center the electrode on the longitudinal axis within a variance of<1°.

6 Claims, 4 Drawing Sheets

LAMP WITH CENTERED ELECTRODE OR IN-LEAD

TECHNICAL FIELD

This invention relates to lamps and more particularly to lamps having improved performance. Still more particularly, it relates to lamps having improved electrode centering whereby the wall temperatures encountered in the electrode area are substantially uniform.

BACKGROUND ART

High intensity discharge lamps, including those of the metal halide variety, provide light by the generation of an electric arc occurring in an evacuated arc chamber provided with light emitting materials such as sodium and scandium halides. The arc chamber or arc tube is formed from quartz and the electrodes are usually tungsten. The arc tube is sealed around the electrodes by means of a press seal, formed by heating the end of the arc tube to a plastic condition with the electrode held in a desired position, and literally pressing the ends of the cylinder together. Because of the differences in thermal expansion between the tungsten electrodes and the quartz it is conventional practice to use a thin molybdenum foil in the press seal area of the tube to modify the stresses imposed upon the seal area of the arc tube during operation, thereby to maintain the environment within the arc tube. While the quartz forms around the tungsten electrode, as well as a lead-in pin extending outside of the arc tube, the hermetic seal itself is made at the moly foil. For truly efficient arc operation it is desirable that the electrodes be closely aligned with the longitudinal axis of the arc tube. This can be difficult to accomplish because of the varying geometries of the components; for example, the moly foil is a thin, flat ribbon and the electrodes and the lead-ins are generally cylindrical.

The prior art has attempted to alleviate this problem by allowing the electrodes to be off-center, as shown in U.S. Pat. No. 5,525,863; by modifying the foil-electrode combination, as shown in U.S. Pat. No. 4,254,356; by flattening a portion of the electrode stem, as shown in U.S. Pat. No. 3,170,081 and U.S. Pat. No. 5,527,199; by slotting the end of the cylindrical members to receive the foil; or by forming a rod-relief protrusion on one side of the seal, as is shown in FIG. 3. Modifying the electrode or support therefor is expensive and time consuming and providing off-centered electrodes limits the range of operation of the lamp in which the arc tube is employed. Additionally, when the electrode forms an angle greater than 0° with the longitudinal axis (3 to 5 degrees was not uncommon in the prior art), uneven heating of the arc tube wall results. This results in over-heating of the wall closest to the electrode and under-heating in the wall farthest from the electrode. Over-heating causes the negative result of shortening the life of the arc tube by either softening the quartz to the point that it deforms or it reacts with the arc tube chemistry. Under-heating causes the negative result of a decreased cold spot temperature within the arc tube causing an undesirable condensation of the arc tube chemicals. As these chemicals condense from the plasma stream, the light quality and efficiency go down. Employing rod-relief provided some improvement; however, this slight improvement has proven insufficient in today's competitive marketplace.

DISCLOSURE OF INVENTION

It is, therefore, an object of the invention to obviate the disadvantages of the prior art.

It is another object of the invention to enhance the operation of arc discharge lamps.

It is yet another object of the invention to provide centered electrodes in an economical manner, without the necessity of modifying existing electrodes or their supporting structure.

These objects are accomplished, in one aspect of the invention, by the provision of an arc tube which comprises an hermetically sealed discharge chamber having a longitudinal axis and containing an arc generating and sustaining medium. The chamber has oppositely disposed sealed ends, each of which sealed ends comprises a substantially parallelepipodonal structure having two oppositely disposed planar sides. A molybdenum foil is sealed in each of the ends, centrally located between the planar sides. An in-lead is connected to the foil and extends externally of the seal, and an electrode is connected to the foil and extends into the discharge chamber. A boss is formed on one of the planar sides and a depression is formed on the other of the planar sides, the boss and the depression cooperating to center the electrodes on the longitudinal axis of the discharge chamber within plus or minus<1°.

The arc tube is manufactured by a method of sealing an arc tube which has a longitudinal axis by the steps of: positioning an end of an arc tube blank at a sealing station; positioning an electrode assembly comprised of an electrode, a sealing foil, and an in-lead in a desired position within the blank; heating the end of the arc tube blank to a plastic state; and forming a press-seal at the end of the blank by engaging the now plastic end with a pair of oppositely disposed press-mold feet, a first of the press-mold feet having a depression aligned along the longitudinal axis and a second of the press-mold feet having a protuberance aligned along the longitudinal axis opposite the depression; and causing the press-mold feet to approach each other to squeeze the plastic material of the end together and form the seal.

Thus, the objects of the invention are easily accomplished without any additional manufacturing steps being performed, thereby resulting in an improved arc tube at no additional cost.

BEST MODE FOR CARRYING OUT THE INVENTION

For a better understanding of the present invention, together with other and further objects, advantages and capabilities thereof, reference is made to the following disclosure and appended claims taken in conjunction with the above-described drawings.

Figure 1:
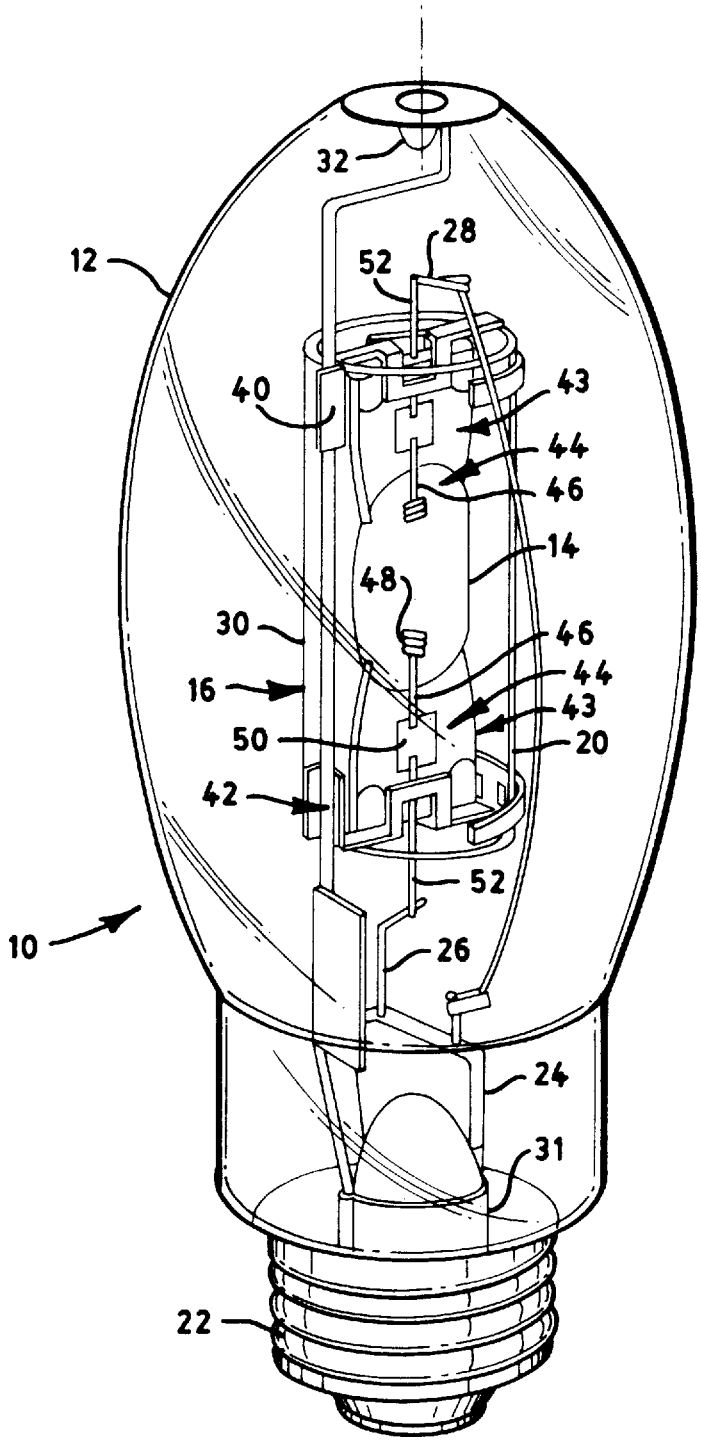
FIG. 1 is a perspective view of a high intensity discharge lamp with which the invention can be employed.

Referring now to the drawings with greater particularity, there is shown in FIG. 1 an exemplary metal halide arc discharge lamp 10 including a lamp envelope 12 and an arc tube 14 mounted within the envelope by mounting frame 16. The arc tube may be positioned within a shroud 20 which can also be supported by the mounting frame 16. Electrical energy is coupled to the arc tube 14 through a base 22, a lamp stem 24 and electrical leads 26 and 28. The are tube contains a chemical fill or dose of materials to provide light when an arc is initiated therein, as is known. The shroud 20 comprises a cylindrical tube of light transmissive, heat resistant material such as quartz.

As noted, in this particular instance, the mounting frame 16 supports both the arc tube 14 and the shroud 20 within the lamp envelope 12. The mounting frame 16 includes a metal support rod 30 attached to lamp stem 24 by a strap 31. The support rod engages an inward projection 32 in the upper end of the lamp envelope 12. The support rod 30 in its central portion is parallel to a central axis of the arc tube 14 and shroud 20. The mounting means 16 further includes an upper clip 40 and a lower clip 42 which secure both arc tube 14 and shroud 20 to support rod 30. The clips 40 and 42 are attached to the support rod 30, preferably by welding.

Positioned in a sealed manner at press-seal ends 43 of the arc tube 14 are electrode assemblies 44. Each electrode assembly 44 comprises an electrode 46 of a suitable material, such as tungsten, and may a have coil 48 attached to one end thereof, internally of the arc tube; a molybdenum sealing foil 50 attached to the other end of the electrode; and an in-lead 52 attached to the opposite end of the molybdenum sealing foil and extending externally of the arc tube for making electrical connection thereto. The electrode assemblies are more clearly seen in FIGS. 2–8. One of the in-leads 52 is connected to electrical lead 26 and one is connected to electrical lead 28.

Figure 2:
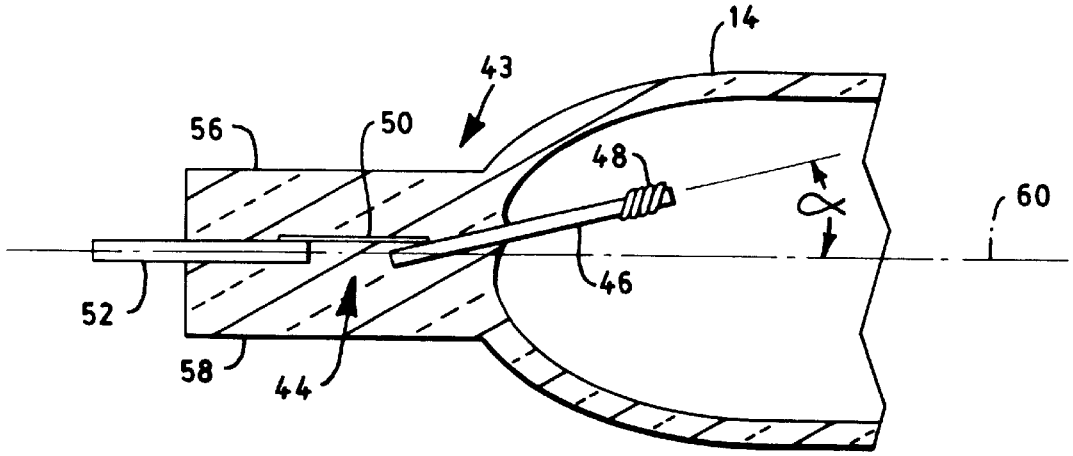
FIG. 2 PRIOR ART
FIG. 2 is a partial, elevational sectional view of a prior art arc tube.

As shown in FIG. 2, prior art arc tubes 14, had a press-seal 43 having a substantially parallelepipodonal structure 54 having two oppositely disposed planar sides 56 and 58, and, after sealing, had the electrode 46 displaced from the longitudinal axis 60 an angle $\alpha$ which was approximately 5°.

Figure 3:
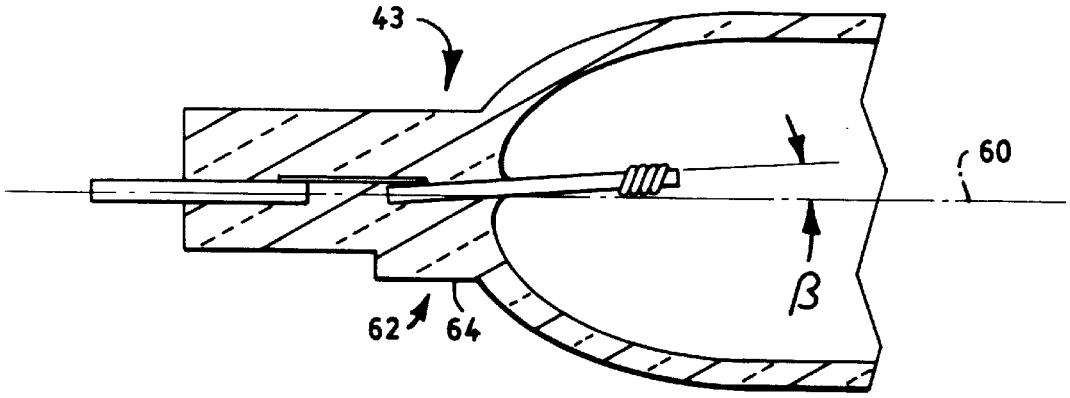
FIG. 3 PRIOR ART
FIG. 3 is a similar view of an additional prior art arc tube.
Figure 5:
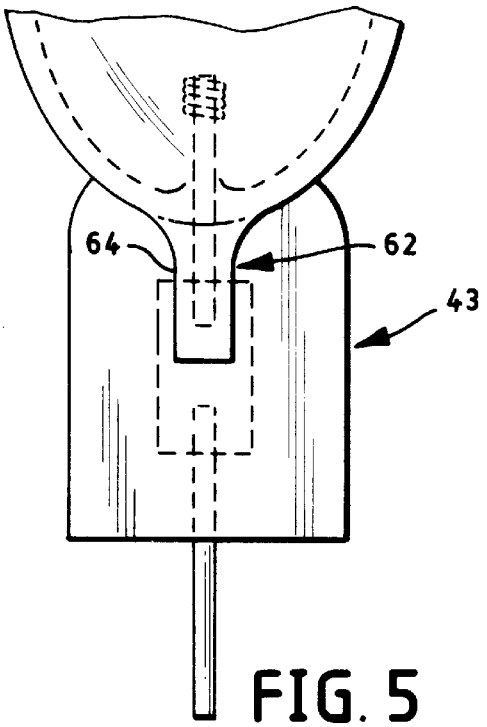
FIG. 5 is a partial elevational view of the prior art arc tube of FIG. 3.

FIGS. 3 and 5 illustrate an improvement, wherein the press-seal 43 was provided with a rod-relief mechanism 62 in the form of a raised protuberance 64. The rod-relief mechanism 62 caused some improvement, resulting in a deviation from the longitudinal axis measured by the angle $\beta$, which approximated about 3°.

Figure 4:
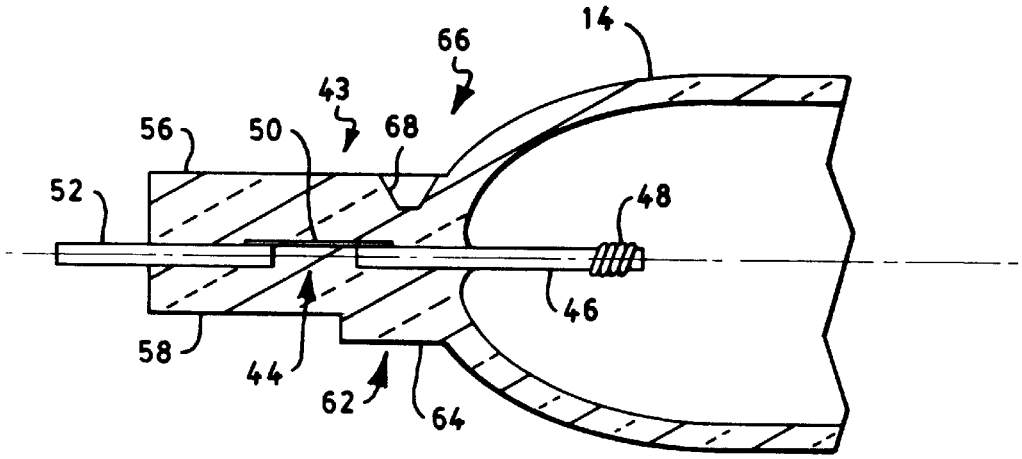
FIG. 4 is a similar view of an embodiment of the invention.

An embodiment of the invention is shown in FIG. 4 wherein an hermetically sealed arc tube 14 has a longitudinal axis 60 and contains therewithin an arc generating and sustaining medium, as is known. The ends of the arc tube 14 are sealed with press-seals 43 (only one of which is shown in FIGS. 2–8). The seals comprise a substantially parallelepipodonal structure having oppositely disposed, planar sides 56 and 58. A molybdenum foil 50 is sealed in each of the press-seals and is substantially centrally located between the planar sides 56 and 58. An in-lead 52 is secured as by welding to an end of foil 50 and extends outwardly of the arc tube for electrical connection to a source and an electrode 46 is attached to the other end of foil 50 and projects into the arc chamber. A first rod-relief member 62 in the form of a projecting boss 64 is formed on one of the planar sides, for example, 58, and a second rod-relief member 66 in the form of a depression 68 is formed on the other of the planar sides, in this instance side 56. The rod-relief members cooperate to center the electrode on the longitudinal axis within a variance of<1°, a vast improvement over the prior art.

Figure 6:
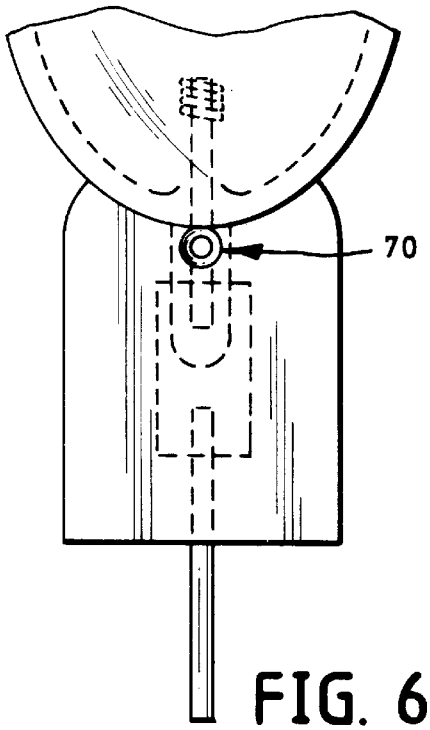
FIG. 6 is a partial elevational view of an embodiment of the invention.
Figure 7:
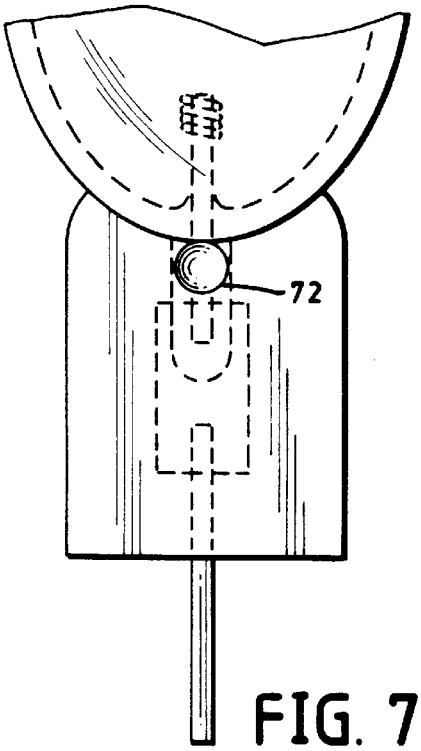
FIG. 7 is a similar view of an alternate embodiment of the invention.
Figure 8:
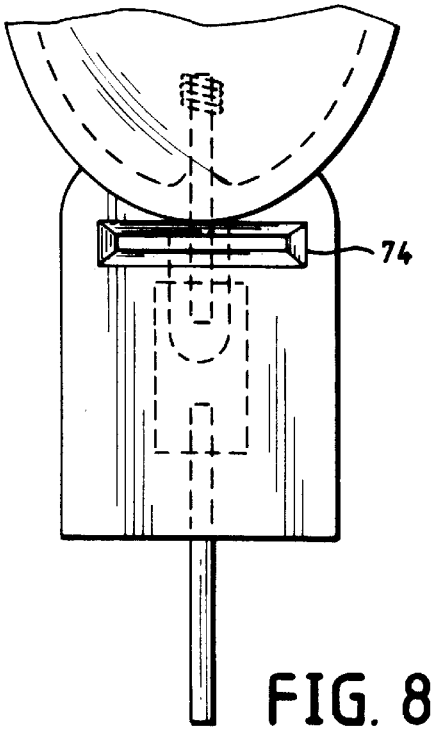
FIG. 8 is a similar view of yet another embodiment of the invention.

While the first rod-relief member 62 takes the form of an elongated protrusion which is parallel to the longitudinal axis 60, the second rod-relief member can be frusto-conical, as shown at 70 in FIG. 6; hemispherical, as shown at 72 in FIG. 7; or elongated and transverse to the first member, as shown at 74 in FIG. 8.

In a preferred embodiment of the invention, the first rod-relief member 62 has a length of about 0.165" (0.42 cm), a width of about 0.060" (0.15 cm) and a depth of about 0.015" (0.04 cm). The second rod-relief member 66 has, in the case of the hemispherical depression 72, a diameter of about 0.035" (0.09 cm) and a depth of about 0.010" (0.025 cm); in the case of the frusto-conical depression 70 a major diameter of 0.035" and a depth of 0.010"; and in the case of the elongated member 74 a width of 0.035", a depth of 0.010" and a length is less than the width of the press-seal. As a minimum, the length is preferably about 0.035".

Figure 9:
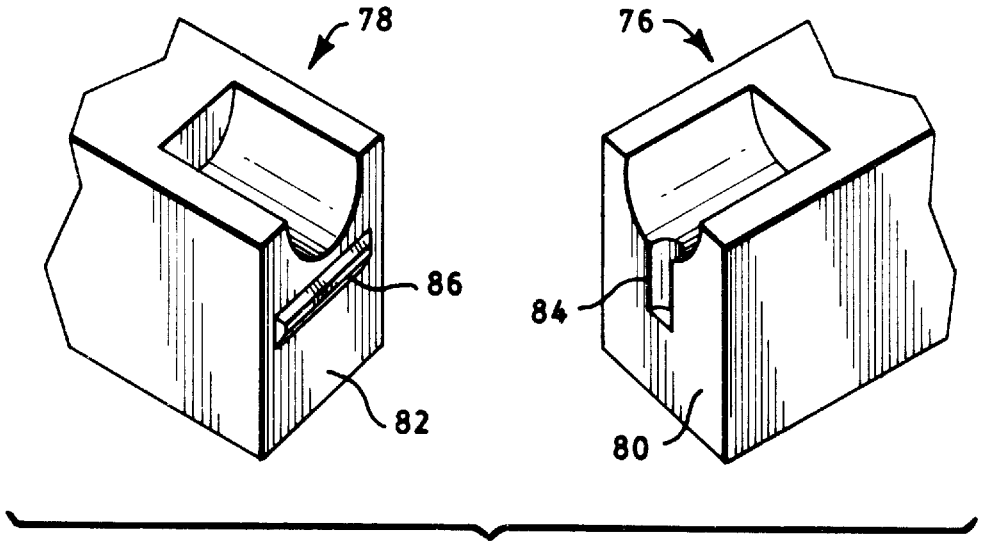
FIG. 9 is an exploded view of the press mold feet of the invention.
Figure 10:
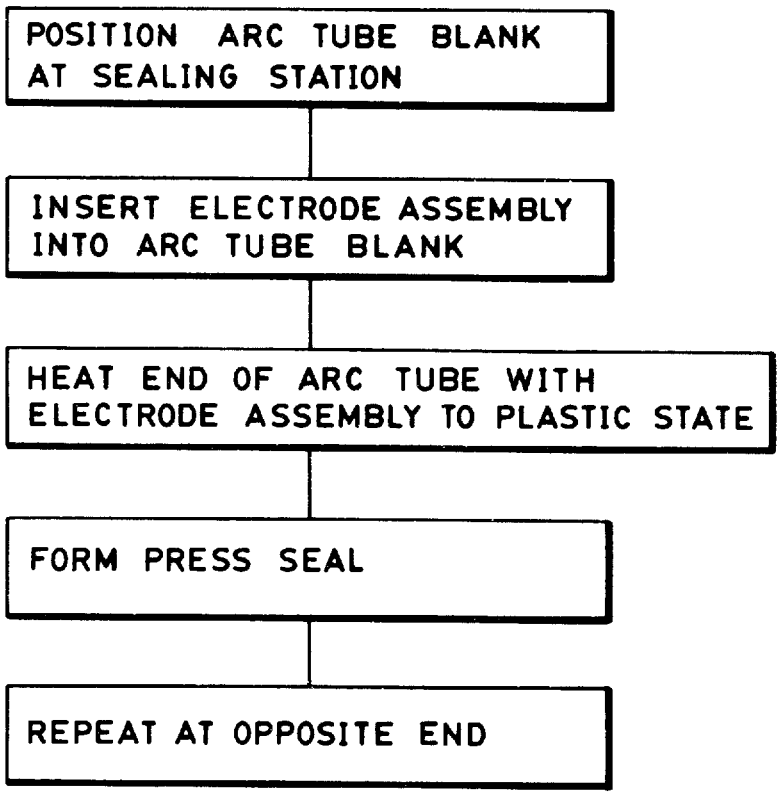
FIG. 10 is a flow diagram of the steps used in carrying out the invention.

A pair of cooperating press-mold sealing feet 76 and 78, for forming press seals in arc discharge lamps is shown in FIG. 9. Each of the feet has a substantially planar sealing surface 80, 82, respectively. Foot 76 contains a depression 84 in the planar surface arrayed along a longitudinal axis thereof. During seal formation this depression will form the first rod-relief member 62. The second foot 78 has a protuberance 86 formed on its planar surface 80, this protuberance being opposite the depression and functioning to form the second rod-relief member during the sealing operation. While the protuberance illustrated is for forming the elongated member 74, it will be apparent to those skilled in the art that the hemispherical depression 72 and the frusto-conical depression 70 will take the appropriate form. Other forms, of course, are possible, such as square or pyramidal, and may be dictated by the size of the arc lamp.

The seals are formed by positioning an arc tube blank at a sealing station and then inserting an electrode assembly thereinto. The end of the blank is heated to a plastic state and the press seal is formed by actuating the press-mold sealing feet. The sealing operations may be performed simultaneously at both ends of the arc tube or sequentially.

Arc tubes thus formed have longitudinally aligned electrodes which provide more efficient operation of the lamps with which they are employed. The solution is economical and consistent, requiring no additional forming steps to be performed upon the electrodes themselves.

The invention is also operable with incandescent lamps having a light source capsule containing a filament supported by in-leads extending externally of the seal and internally of the capsule.

While there have been shown an described what are at present considered the preferred embodiments of the invention, it will be apparent to those skilled in the art that various changes and modifications can be made herein without departing from the scope of the invention as defined by the appended claims.

What is claimed is:

1. An arc tube comprising: an hermetically sealed discharge chamber having a longitudinal axis and containing an arc generating and sustaining medium and having oppositely disposed sealed ends, each of said sealed ends comprising a substantially parallelepipodonal structure having two oppositely disposed planar sides; a molybdenum foil sealed in each of said ends, centrally located between said planar sides; an in-lead connected to said foil and extending externally of said seal; an electrode connected to said foil and extending into said discharge chamber; a boss formed on one of said planar sides; and a depression formed on the other of said planar sides, said boss and said depression cooperating to substantially center said electrodes on said longitudinal axis of said discharge chamber.

2. The arc tube of claim 1 wherein said depression is frusto-conical.

3. The arc tube of claim 1 wherein said depression is hemispherical.

4. The arc tube of claim 1 wherein said boss is elongated and parallel to said longitudinal axis and said depression is elongated and orthogonal to said longitudinal axis.

5. The arc tube of claim 1 wherein said electrodes are aligned with said longitudinal axis to within plus or minus<1°.

6. A light source capsule comprising: an hermetically sealed chamber having a longitudinal axis and containing a light providing filament and having oppositely disposed sealed ends, each of said ends comprising a substantially parallelepipodonal structure having two oppositely disposed planar sides; an in-lead extending externally of each of said seals and internally of said capsule whereby said internal extensions have internal terminations, said internal terminations supporting said filament; a boss formed on one of said planar sides; and a depression formed on the other of said planar sides, said boss and said depression cooperating to substantially center said in-leads on said longitudinal axis.

* * * * *